US006644530B2

(12) United States Patent
Chen

(10) Patent No.: US 6,644,530 B2
(45) Date of Patent: Nov. 11, 2003

(54) NAIL STAPLER

(76) Inventor: Mu-Yu Chen, No. 78, Ta Tun 17th Street, Hsi Tun District, Taichung (TW)

( * ) Notice: Subject to any disclaimer, the term of this patent is extended or adjusted under 35 U.S.C. 154(b) by 0 days.

(21) Appl. No.: 10/267,067

(22) Filed: Oct. 9, 2002

(65) Prior Publication Data

US 2003/0094477 A1 May 22, 2003

(30) Foreign Application Priority Data

Nov. 21, 2001 (TW) ..... 90220243 U

(51) Int. Cl.[7] ..... B25C 1/04
(52) U.S. Cl. ..... 227/109; 227/120
(58) Field of Search ..... 227/109, 120, 227/119, 135, 136

(56) References Cited

U.S. PATENT DOCUMENTS 5,522,533 A * 6/1996 Mukoyama et al. ..... 227/109
5,632,431 A * 5/1997 Lin ..... 227/120
5,692,665 A * 12/1997 Lee ..... 227/119
5,873,509 A * 2/1999 Liao ..... 227/120
5,934,539 A * 8/1999 Lee ..... 227/109
5,967,396 A * 10/1999 Chuang ..... 227/120
6,161,746 A * 12/2000 Wey ..... 227/109
6,564,985 B1 * 5/2003 Chou ..... 227/109

* cited by examiner

*Primary Examiner*—Scott A. Smith
(74) *Attorney, Agent, or Firm*—Charles E. Baxley

(57) ABSTRACT

A nail stapler magazine includes a first shell, an outlet element, a second shell, a plurality of positioning strips and a pusher. The first shell includes a first end, a second end, a deep groove defined therein for receiving nails each including a head, and a plurality of shallow grooves defined therein. When the nails are received in the magazine, their heads are received in one of the shallow grooves. The outlet element is formed at the first end of the first shell. The outlet element defines a slot through which the nails can be sent from the first shell into the outlet element and an outlet through which the nails can be ejected from the outlet element. The second shell is movable on the first shell. The second shell includes a first end, a second end and a plurality of grooves defined therein. Each of the positioning strips is received in one of the grooves defined in the second shell. Each of the positioning strips includes a protrusion for pressing the nails against the first shell. The pusher is movable between the first shell and the second shell. The pusher is movable between the first shell and the second shell. The pusher includes a palm, a plurality of fingers extending from the palm for pushing the nails to the outlet element and a plurality of slots each separating adjacent two of the fingers and corresponding to one of the positioning strips.

14 Claims, 6 Drawing Sheets

NAIL STAPLER

BACKGROUND OF INVENTION

1. Field of Invention

The present invention relates to a nail stapler.

2. Related Prior Art

Taiwanese Patent Publication No. 369990 discloses a magazine of a nail stapler that can firmly hold nails of different widths and heights therein. This conventional magazine includes many elements and is complicated in structure and therefore high in cost.

The present invention is therefore intended to obviate or at least alleviate the problems encountered in prior art.

SUMMARY OF INVENTION

It is the primary objective of the present invention to provide a simple magazine of a nail stapler that can firmly hold nails of different widths and heights therein.

According to the present invention, a nail stapler magazine includes a first shell, an outlet element, a second shell, a plurality of positioning strips and a pusher. The first shell includes a first end, a second end, a deep groove defined therein for receiving nails each including a head, and a plurality of shallow grooves defined therein. When the nails are received in the magazine, their heads are received in one of the shallow grooves. The outlet element is formed at the first end of the first shell.

The outlet element defines a slot through which the nails can be sent from the first shell into the outlet element and an outlet through which the nails can be ejected from the outlet element. The second shell is movable on the first shell. The second shell includes a first end, a second end and a plurality of grooves defined therein. Each of the positioning strips is received in one of the grooves defined in the second shell. Each of the positioning strips includes a protrusion for pressing the nails against the first shell. The pusher is movable between the first shell and the second shell. The pusher includes a palm, a plurality of fingers extending from the palm for pushing the nails to the outlet element and a plurality of slots each separating adjacent two of the fingers and corresponding to one of the positioning strips.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings.

DETAILED DESCRIPTION OF PREFERRED EMBODIMENT

Figure 1:
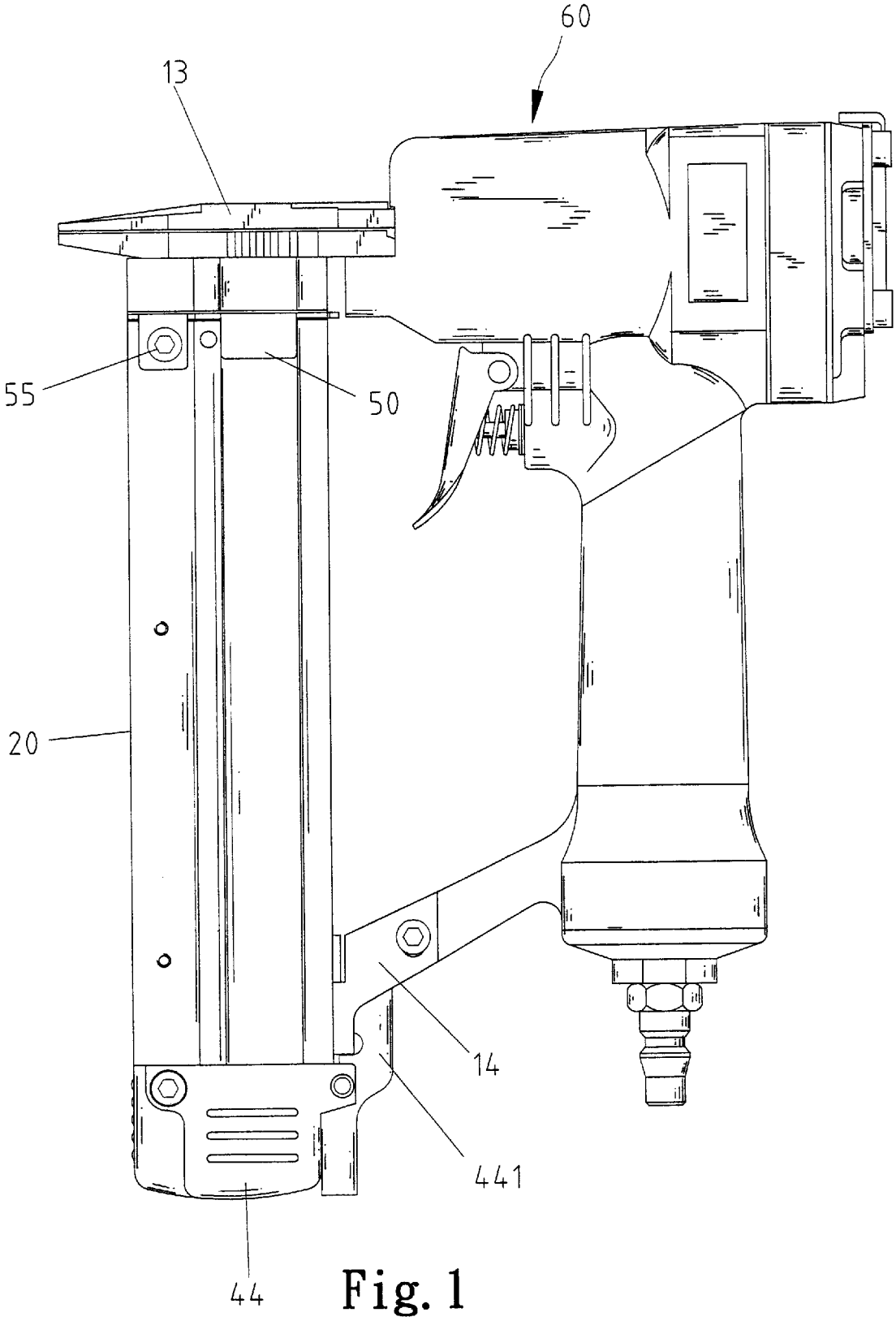
FIG. 1 is a side view of a nail stapler equipped with a magazine according to the present invention.

Referring to FIGS. 1, a nail stapler 60 is equipped with a magazine according to the preferred embodiment of the present invention.

Figure 2:
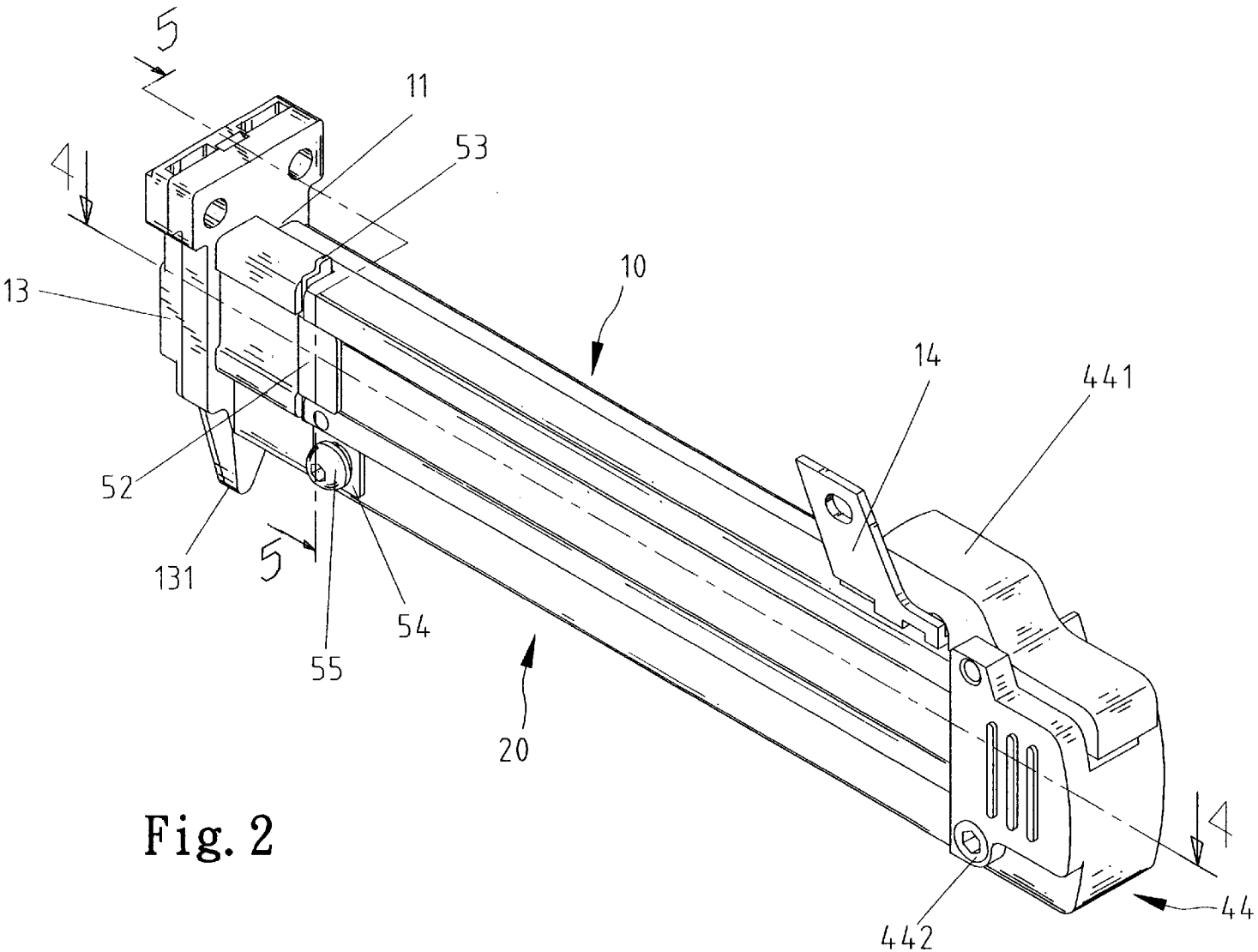
FIG. 2 is a perspective view of the magazine according to the present invention.
Figure 3:
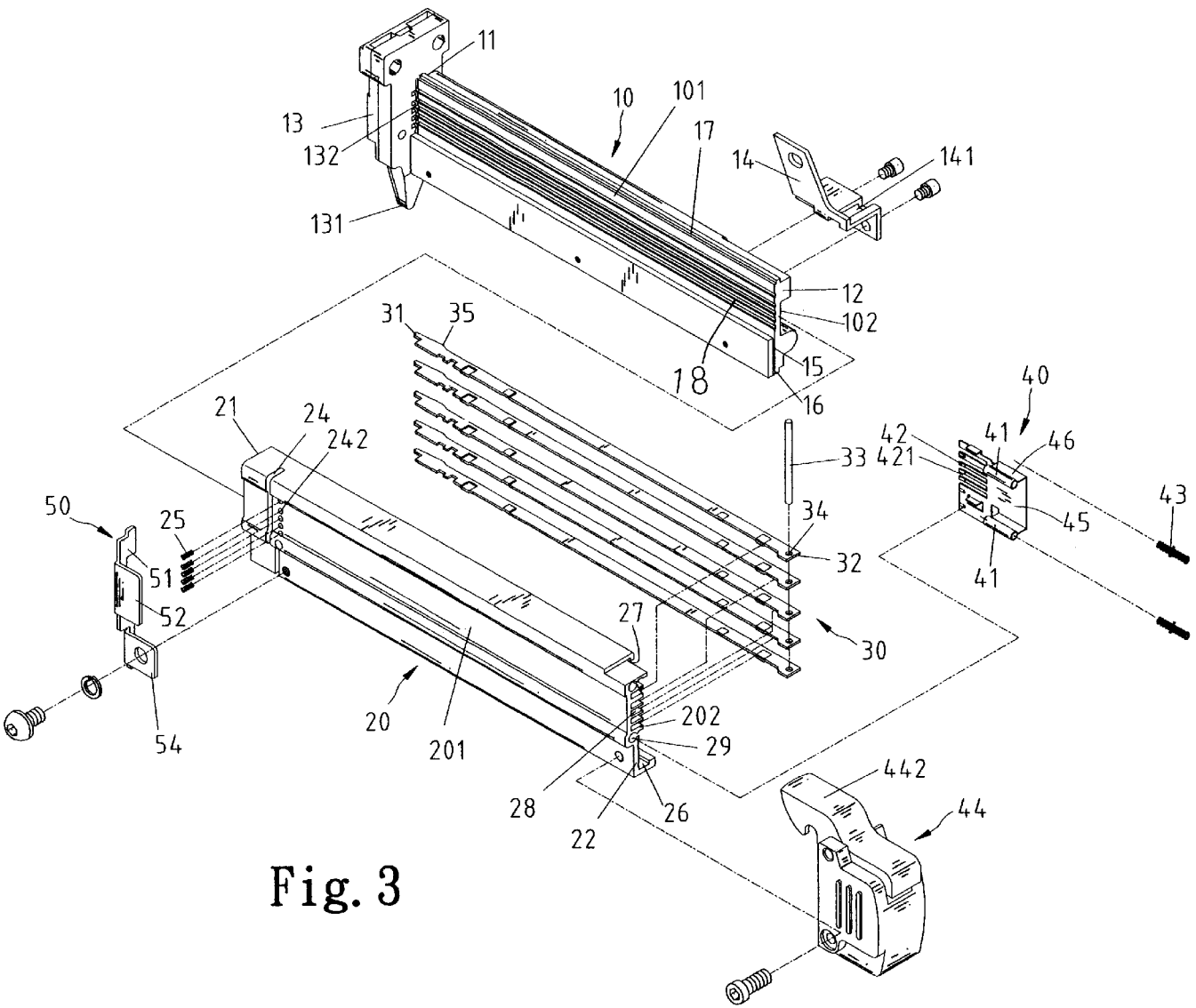
FIG. 3 is an exploded view of the magazine according to the present invention.

Referring to FIGS. 2 and 3, the magazine includes a first shell 10, a second shell 20, a plurality of positioning strips 30 and a pusher 40.

The first shell 10 includes a first end 11 and a second end 12. The first shell 10 further includes a first side 101, a second side 102, a lower edge 16 and an upper edge 17 that all extend between the first end 11 and the second end 12. The lower edge 16 is U-shaped when view in an end view. Thus, a groove 15 is defined in the lower edge 16 for receiving nails (not shown) that are generally formed together with one 22 another in a row. Each of the nails includes a head. A plurality of grooves 18 is defined in the first side 101 of the first shell 11. When the nails are received in the magazine, their heads are received in one of the grooves 18. An outlet element 13 is formed at the first end 11 of the first shell 10. The outlet element 13 defines a slot 132 through which the nails can be passed. The slot 132 includes a plurality of enlarged portions corresponding to the grooves 18. The outlet element 13 includes an outlet 131 through which the nails can be ejected so as to nail wood or the like. A connector 14 is secured to the second side 102 of the first shell 11 near the upper edge 17. The connector 14 defines a hole or recess 141. The first shell 11, the outlet element 13 and the connector 14 are conventional and will not be described in detail.

The second shell 20 includes a first end 21 and a second end 22. Furthermore, the second shell 20 includes a first side 201, a second side 202, a lower rim 26 and an upper edge 27 that all extend between the first end 21 and the second end 22. The lower rim 26 of the second shell 20 is configured to receive the lower edge 16 of the first shell 10. The upper rim 27 of the second shell 20 is configured to receive the upper edge 17 of the first shell 10. A plurality of grooves 18 and two tunnels 29 are defined in the second side 201 of the second shell 20 so that the grooves 18 are located between the tunnels 29. A slot 24 is defined in the second shell 20 so as to be in communication with the grooves 28. A plurality of holes 242 is defined in the second shell 20 so that each of the holes 242 is in communication with one of the grooves 28.

Each of the positioning strips 30 includes a first end 31 and a second end 32 in which a hole 34 is defined. A pin 33 is inserted through the holes 34 in order to assemble the positioning strips 30 in a pivotal manner. Each of the positioning strips 30 includes a protrusion 35 formed on an edge.

The pusher 40 includes a plurality of fingers 42 and a palm 45 from which the fingers 42 extend. The fingers 42 and the palm 45 extend in a same plane. The fingers 42 are separated from one another by.means of a plurality of slots 421. The pusher 40 includes two fins 46 projecting from a side of the palm. A tube 41 is formed on each of the fins 46. Each of the tubes 41 includes a closed end and an open end.

A stop 44 includes a hook 442 pivotally mounted thereon. The stop 44 is conventional and therefore will not be described in detail.

A stop/cover 50 includes a stop 51, a cover 52 extending perpendicular to the stop 51 and an attachment portion 54 integrated with the stop 51.

In assembly, the positioning strips 30 are received in the grooves 28. The tubes 41 are inserted in the tunnels 29. Thus, the positioning strips 30 are retained in the grooves 28 by means of the palm 45. An end of a spring 43 is inserted into each of the tubes 41 through the open end. The stop 44 is secured to the second end 22 of the second shell 20. Thus, the springs 43 bias the pusher 40 toward the first end 21 of the second shell 20. The stop 51 is inserted in the slot 24. Thus, the pusher 40 is retained on the second shell 20 by means of the stop 51 and the stop 44. A spring 25 is received in each of the holes 242. The attachment portion 54 is secured to the first side 201 of the second shell 20. The holes 242 are covered by means of the cover 52. Thus, the cover 52 retains the springs 25 in the holes 242, and the springs 25 bias the positioning strips 30 away from the second side of the second shell 20, i.e., toward the first side 101 of the first shell 10.

For use, the nails are received in the groove 15 and their heads are received in one of the grooves 18. The first shell 11 is positioned beside and moved relative to the second shell 20 so that the edges 16 and 17 of the first shell 11 are held by means of the rims 26 and 27 of the second shell 20. The hook 442 is inserted in the recess 141, thus completing the assembly of the magazine.

Figure 4:
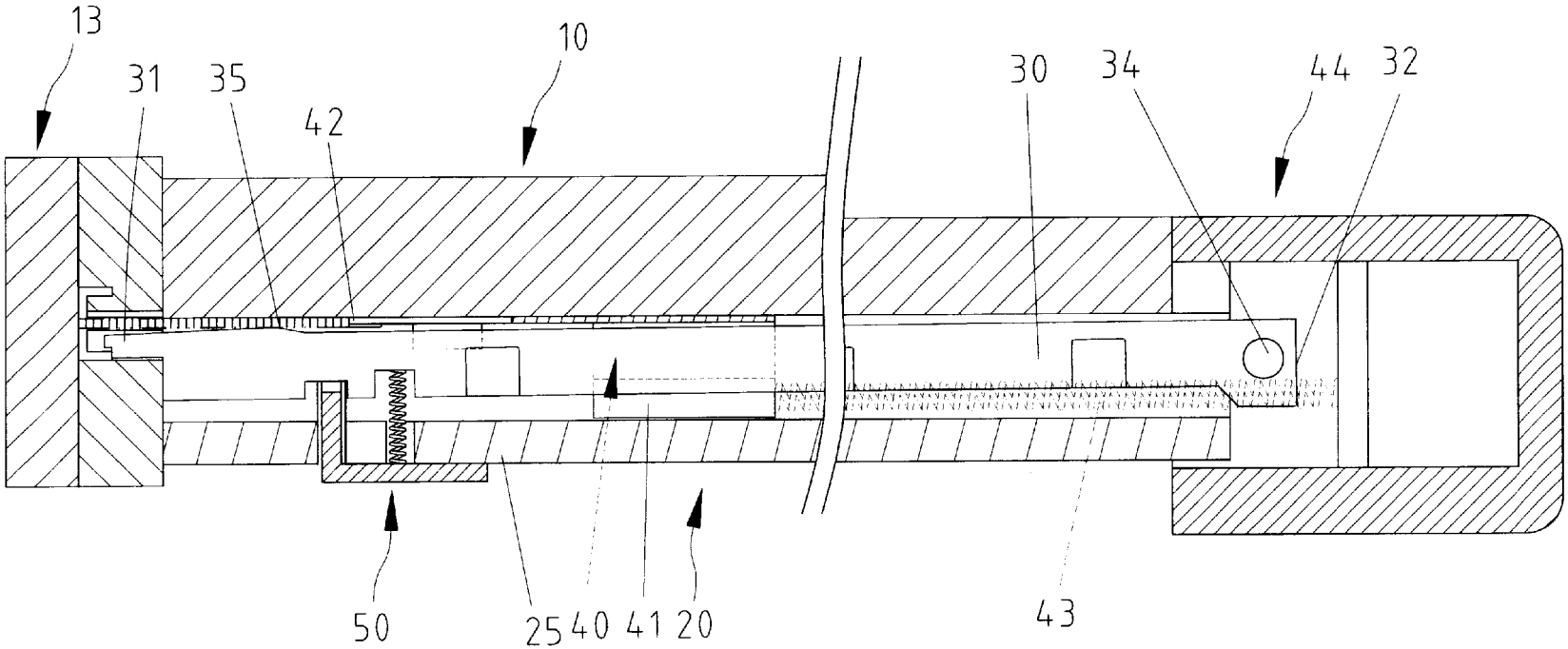
FIG. 4 is a cross-sectional view taken along a line 4—4 in FIG. 2, showing the magazine containing some nails.

Referring to FIG. 4, the nails are pushed to the outlet element 11 by means of the pusher 40. Some of the positioning strips 30 biased by the springs 25 contact some of the nails so as to push the nails against the first side 101 of the first shell 10. Thus, the nails do not shake in the magazine.

Figure 5:
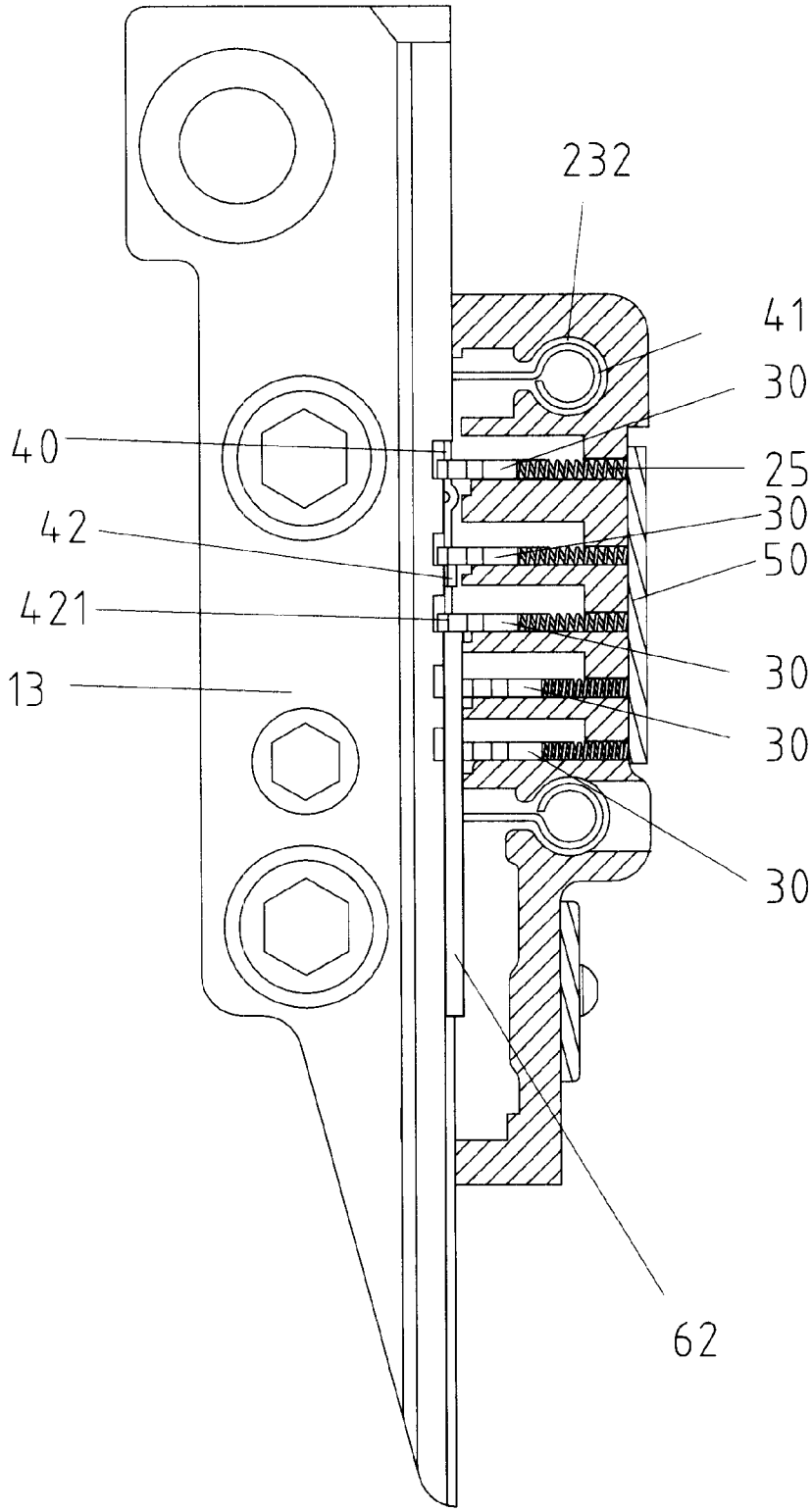
FIG. 5 is a cross-sectional view taken along a line 5—5 in FIG. 2, showing the magazine containing short nails.

Referring to FIG. 5, short nails 62 are received in the magazine. The heads of the short nails 62 are received in the third one (counted from the lowermost one to the uppermost one) of the grooves 18. The protrusions 35 of the first and second ones of the positioning strips 30 contact some of the short nails 62, and the protrusion 35 of the third one of the positioning strips 30 contacts their heads. Thus, the short nails 62 are retained against the first side 101 of the first shell 10.

Figure 6:
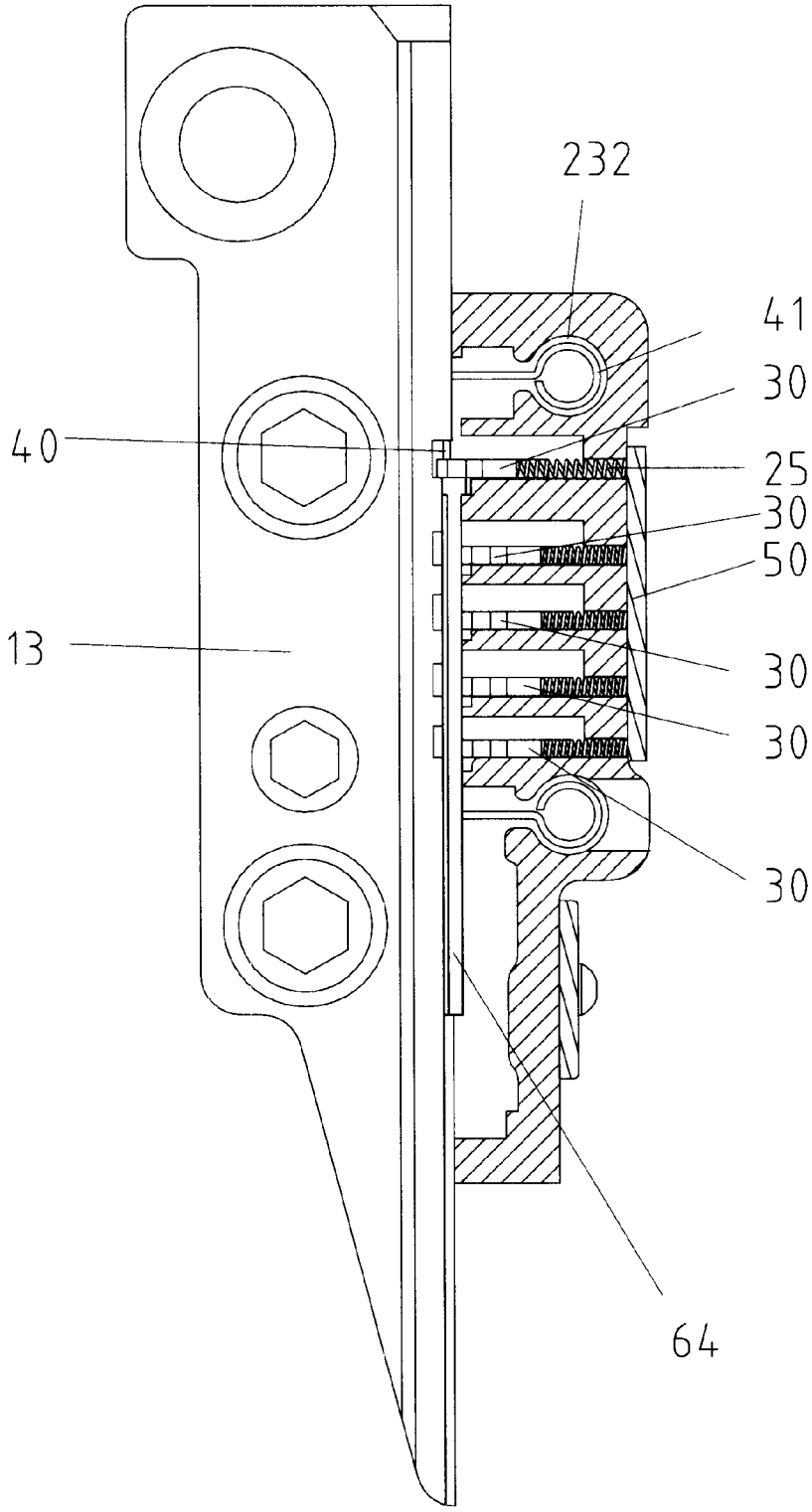
FIG. 6 is similar to FIG. 6, but showing the magazine containing long nails.

Referring to FIG. 6, long nails 64 are received in the magazine. The heads of the long nails 64 are received in the fifth one (counted from the lowermost one to the uppermost one) of the grooves 18. The protrusions 35 of the first, second, third and fourth ones of the positioning strips 30 contact some of the long nails 64, and the protrusion 35 of the fifth one of the; positioning strips 30 contacts their heads. Thus, the long nails 64 are retained against the first side 101 of the first shell 10.

The slots 421 defined between the fingers 42 are used to ensure that the protrusions 35 of the positioning strips 30 push the nails against the first side of the first shell 10. In detail, when the fingers 42 reach the outlet element 13, the protrusions 35 of the positioning strips 30 extend through the slots 421 defined between the fingers 42 so as to push the nails against the first side of the first shell 10.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A nail stapler magazine including:

a first shell including a first end, a second end, a deep groove defined therein for receiving nails each including a head, and a plurality of shallow grooves defined therein, wherein when the nails are received in the magazine, their heads are received in one of the shallow grooves;

an outlet element formed at the first end of the first shell, the outlet element defining a slot through which the nails can be sent from the first shell into the outlet element and an outlet through which the nails can be ejected from the outlet element;

a second shell movable on the first shell, the second shell including a first end, a second end and a plurality of grooves defined therein;

a plurality of positioning strips each received in one of the grooves defined in the second shell, each of the positioning strips including a protrusion for pressing the nails against the first shell; and a pusher movable between the first shell and the second shell, the pusher including a palm for pushing the nails to the outlet element, a plurality of fingers extending from the palm and a plurality of slots each separating adjacent two of the fingers and corresponding to one of the positioning strips.

2. The magazine according to claim 1, including at least one elastic element arranged between the second shell and the positioning strips in order to bias the positioning strips toward the nails.

3. The magazine according to claim 1, including five elastic elements each arranged between the second shell and one of the positioning strips in order to bias the positioning strips toward the nails.

4. The magazine according to claim 3 wherein the second shell defines a plurality of holes for receiving one of the elastic elements.

5. The magazine according to claim 4 wherein the holes extend through the second shell and the magazine includes a cover attached to the second shell for sealing the holes.

6. The nail stapler magazine according to claim 1 wherein each of the positioning strips includes a first end and a second end, and the second end of the positioning strips are bundled with one another.

7. The nail stapler magazine according to claim 6 wherein each of the positioning strips includes a hole defined in the second end and the magazine includes a pin inserted through the holes defined in the positioning strips in order to bundle the positioning strips in a pivotal manner.

8. The nail stapler magazine according to claim 1 wherein the pusher includes two fins projecting from a side of the palm and the second shell includes two tunnels defined therein for receiving the fins.

9. The nail stapler magazine according to claim 8 wherein the pusher includes two tubes each formed on one of the fins and received in one of the tunnels.

10. The nail stapler magazine according to claim 9 wherein each of the tubes includes a closed end and an open end for receiving a spring.

11. The nail stapler magazine according to claim 1 wherein the slot defined in the outlet element includes a plurality of enlarged portions corresponding to the grooves.

12. The magazine according to claim 1 wherein the first shell includes a lower edge in which the deep groove is defined.

13. The magazine according to claim 1 wherein the first shell includes a lower edge and an upper edge and the second shell includes a lower rim for receiving the lower edge of the first shell and an upper rim for receiving the upper edge of the first shell.

14. The nail stapler magazine according to claim 1 including:

a connector attached to the first shell, the connector defining a recess; and a stop attached to the second shell, the stop including a hook pivotally mounted thereon for insertion in the recess defined in the connector.

* * * * *